US007699245B1

(12) United States Patent
Rappin

(10) Patent No.: US 7,699,245 B1
(45) Date of Patent: Apr. 20, 2010

(54) NOZZLE SPRAY ASSEMBLY III

(75) Inventor: Craig Rappin, Cary, IL (US)

(73) Assignee: Roll, LLC, Cary, IL (US)

( * ) Notice: Subject to any disclaimer, the term of this patent is extended or adjusted under 35 U.S.C. 154(b) by 714 days.

(21) Appl. No.: 11/538,255

(22) Filed: Oct. 3, 2006

Related U.S. Application Data

(60) Division of application No. 10/974,400, filed on Oct. 26, 2004, now Pat. No. 7,213,773, which is a continuation-in-part of application No. 10/924,522, filed on Aug. 24, 2004, now abandoned.

(51) Int. Cl.
*B05B 7/30* (2006.01)

(52) U.S. Cl. ..... 239/340; 239/310; 239/424.5; 239/555; 239/562; 239/596; 239/581.1; 239/77; 43/132.1

(58) Field of Classification Search ..... 43/128, 43/132.1; 239/67, 71, 77, 128, 129, 152, 239/154, 310–318, 340–371, 407, 418, 437, 239/581.1, 423–245.5, 554, 555, 559, 562, 239/567, 596; 261/35, 76, 78.2, 115, 116
See application file for complete search history.

(56) References Cited

U.S. PATENT DOCUMENTS

| | | | | |
|---|---|---|---|---|
| 1,475,957 | A | 12/1923 | Lemons | |
| 1,947,743 | A | 2/1934 | Schoeneck | |
| 1,986,407 | A | 1/1935 | Parker | |
| 2,399,090 | A * | 4/1946 | Ballak | 470/23 |
| 2,708,596 | A | 5/1955 | Weller | |
| 2,738,226 | A | 3/1956 | Bals | |
| 3,332,231 | A * | 7/1967 | Walsh | 60/274 |
| 3,776,459 | A | 12/1973 | Bonvicini | |
| 4,089,441 | A | 5/1978 | Cole et al. | |
| 4,111,364 | A | 9/1978 | Schroeder | |
| 4,244,062 | A | 1/1981 | Corsette | |
| 4,474,327 | A | 10/1984 | Mattson et al. | |
| 4,476,515 | A | 10/1984 | Coffee | |
| D280,125 | S | 8/1985 | Butterfield et al. | |
| 4,597,203 | A | 7/1986 | Middleton | |

(Continued)

FOREIGN PATENT DOCUMENTS

| | | |
|---|---|---|
| EP | 0837738 | 4/1998 |

(Continued)

OTHER PUBLICATIONS

Non-Final Office Action issued on Dec. 5, 2008 for U.S. Appl. No. 11/532,255, filed Sep. 18, 2006.

(Continued)

*Primary Examiner*—Len Tran
*Assistant Examiner*—Jason J Boeckmann
(74) *Attorney, Agent, or Firm*—Neal, Gerber & Eisenberg LLP

(57) ABSTRACT

A nozzle spray assembly for insecticide made in two halves that are connected together and define an internal reservoir. The lower half has an arcuate shaped exterior surface and includes an inlet tube in communication with the reservoir. The lower half also has nozzle openings adjacent the arcuate surface so that when air is directed over the arcuate surface past the nozzle openings fluid is sucked into the inlet tube and reservoir and out the nozzle openings to spray insecticide onto the surrounding area.

8 Claims, 17 Drawing Sheets

U.S. PATENT DOCUMENTS

| | | | |
|---|---|---|---|
| 4,688,643 | A | 8/1987 | Carter et al. |
| D293,929 | S | 1/1988 | Verhees |
| D294,287 | S | 2/1988 | Verhees |
| 4,768,714 | A | 9/1988 | Luchsinger |
| 5,176,303 | A | 1/1993 | Franke |
| 5,195,208 | A | 3/1993 | Yamami et al. |
| 5,240,186 | A | 8/1993 | Dobbins et al. |
| 5,303,866 | A | 4/1994 | Hawks, Jr. |
| 5,385,106 | A | 1/1995 | Langshaw |
| 5,429,278 | A | 7/1995 | Sansalone |
| 5,562,248 | A | 10/1996 | Khalifka |
| 5,636,791 | A | 6/1997 | Leer |
| 5,671,884 | A | 9/1997 | Restive |
| 5,678,766 | A | 10/1997 | Peck et al. |
| 5,727,707 | A | 3/1998 | Wickland et al. |
| 5,752,661 | A | 5/1998 | Lewis |
| 5,813,088 | A | 9/1998 | Wagner et al. |
| D408,495 | S | 4/1999 | Adams |
| 5,947,384 | A | 9/1999 | McCauley |
| 5,988,414 | A | 11/1999 | Schwartz et al. |
| 6,003,199 | A | 12/1999 | Shaffer |
| 6,092,260 | A | 7/2000 | Kai |
| 6,185,917 | B1 | 2/2001 | Goudes |
| D439,636 | S | 3/2001 | Hamilton |
| 6,206,300 | B1 | 3/2001 | Roudebush et al. |
| 6,223,827 | B1 | 5/2001 | Zuev et al. |
| 6,371,388 | B2 | 4/2002 | Utter et al. |
| 6,409,097 | B1 | 6/2002 | McCauley |
| 6,575,695 | B1 | 6/2003 | Miyamoto |
| 6,776,133 | B2 | 8/2004 | Tezuka et al. |
| 6,793,563 | B2 | 9/2004 | Daniel |
| 6,834,413 | B2 | 12/2004 | Sanders et al. |
| 6,837,447 | B1 | 1/2005 | Clark |
| 6,889,773 | B2 | 5/2005 | Hanratty |
| 7,007,826 | B2 | 3/2006 | Shapanus et al. |
| 7,021,391 | B2 | 4/2006 | Schasteen |
| 7,055,213 | B2 | 6/2006 | Iida et al. |
| 7,065,944 | B1 | 6/2006 | Steele |
| 7,073,734 | B2 | 7/2006 | Dorendorf et al. |
| 7,086,616 | B2 | 8/2006 | Murphy et al. |
| D542,376 | S | 5/2007 | Blete et al. |
| 7,213,773 | B1 | 5/2007 | Rappin |
| 7,234,653 | B2 | 6/2007 | Powell et al. |
| D558,300 | S | 12/2007 | Rappin |
| 7,374,111 | B2 | 5/2008 | Joseph et al. |
| 7,437,796 | B2 | 10/2008 | Rappin |
| 2001/0041316 | A1 | 11/2001 | Haynes et al. |
| 2004/0123991 | A1 | 7/2004 | Hanratty |
| 2004/0135004 | A1 | 7/2004 | Fex |
| 2005/0006400 | A1 | 1/2005 | Shapanus et al. |
| 2007/0029407 | A1 | 2/2007 | Rappin |
| 2007/0119972 | A1 | 5/2007 | Fex |
| 2007/0170187 | A1 | 7/2007 | Tharp et al. |
| 2008/0011708 | A1 | 1/2008 | Rappin |
| 2008/0163450 | A1 | 7/2008 | Disanto |
| 2008/0172826 | A1 | 7/2008 | Rappin |

FOREIGN PATENT DOCUMENTS

| | | |
|---|---|---|
| GB | 2095966 | 10/1982 |
| JP | 2001193697 | 7/2001 |

OTHER PUBLICATIONS

Non-Final Office Action issued on May 1, 2008 for U.S. Appl. No. 11/461,925, filed Aug. 2, 2006.

Final Office Action issued on Nov. 20, 2008 for U.S. Appl. No. 11/461,925, filed Aug. 2, 2006.

Non-Final Office Action issued on Dec. 23, 2008 for U.S. Appl. No. 11/456,654.

The International Search Report and The Written Opinion of the International Searching Authority mailed on Apr. 2, 2009 with regard to PCT/US2008/069936.

* cited by examiner

NOZZLE SPRAY ASSEMBLY III

This application is a divisional application of a continuation-in-part application of Ser. No. 10/974,400 entitled Nozzle Spray Assembly II filed Oct. 26, 2004. The aforementioned application Ser. No. 10/974,400 was a continuation-in-part application entitled "Nozzle Spray Assembly," Ser. No. 10/924,522 filed on Aug. 24, 2004.

BACKGROUND OF THE INVENTION

Eradicating flying insects from areas surrounding one's property for extended periods of time on the order of 2-4 weeks is an ongoing concern of the property owner. Various insecticides in the form of canned sprays have been utilized with moderate success for mosquito control and the like. There have also been used very elaborate spraying systems such as thermal foggers, traps, traps with attractants, commercial spraying systems that are truck mounted, commercial spray systems that are backpack type sprayers, permanently installed mist systems, etc. that are often expensive and very cumbersome to use. None of the above make use of a hand-held blower universal attachment kit.

There has long been the need for a compact, portable, highly effective nozzle system that can be used with readily available equipment to conveniently spray up to at least 30,000 square feet without difficulty.

SUMMARY OF THE INVENTION

In accordance with the present invention there is provided a novel assembly that can be readily attached to an outlet pipe of a yard blower or leaf blower to dispense insecticide over a relatively large area. The nozzle assembly is connected to a source of insecticide that can be conveniently carried by a web belt carrier disposed around the waist of the operator. The nozzle assembly is positioned securely to the end portion of an outlet tube of a readily available blower assembly and is suitably designed so the flow of pressurized air from the blower is directed around the nozzle assembly and creates a partial vacuum to draw insecticide out of a container containing the insecticide through nozzle openings formed in the nozzle assembly. The insecticide flowing from the nozzle openings is sheared across the top of the nozzle opening and turned into micro-droplets that is dispersed into the air from the blower creating a mist flow that can be directed to the area of treatment. In one embodiment the nozzle openings located in the assembly are adjustable so the flow therethrough can be varied. In the relevant illustrated embodiment there are 3 nozzle configurations at 6 equally spaced locations to provide relatively high, medium and low flow. In this embodiment the two halves of the nozzle assembly are secured together by a centrally disposed screw. In a second embodiment the nozzle openings are not adjustable and connected together by two outwardly disposed connectors that leaves the central reservoirs receiving the insecticide free of the aforementioned screw connection. A third embodiment is also disclosed made of upper, lower and intermediate sections employing outwardly disposed connectors similar to those illustrated in the second embodiment but in this embodiment the fasteners are located between the intermediate and lower sections. The nozzle openings are located in the upper portion of the intermediate section and the connectors are secured between the intermediate and lower sections.

BRIEF DESCRIPTION OF THE DRAWINGS

The three embodiments of the novel nozzle spray assembly can best be understood from the following description of the drawings in which.

DETAILED DESCRIPTION OF THE DRAWINGS

Figure 1:
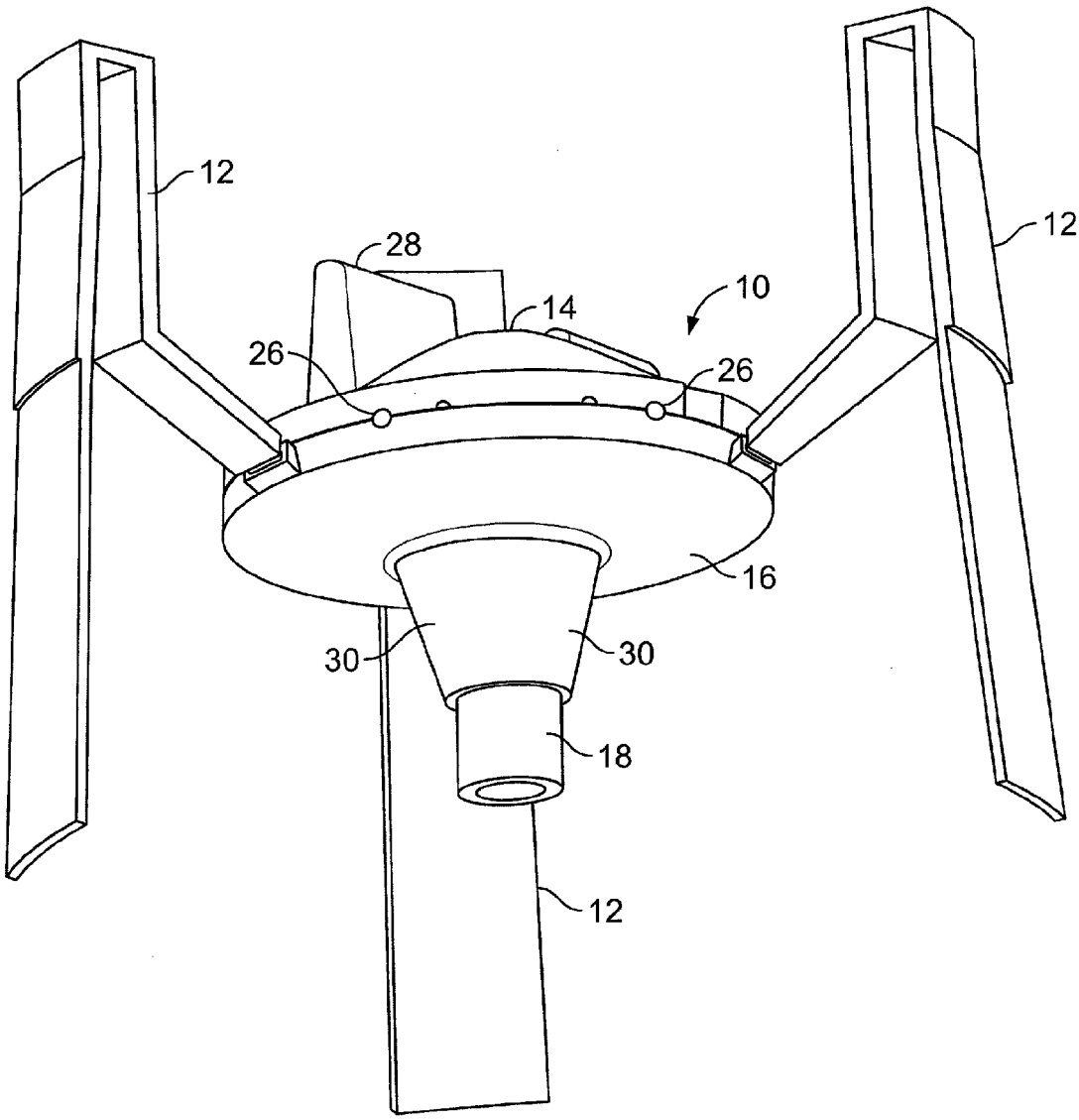
FIG. 1 is a perspective view of the first embodiment of the nozzle assembly and the support therefor for mounting in the outlet pipe of an air blower pipe.
Figure 8:
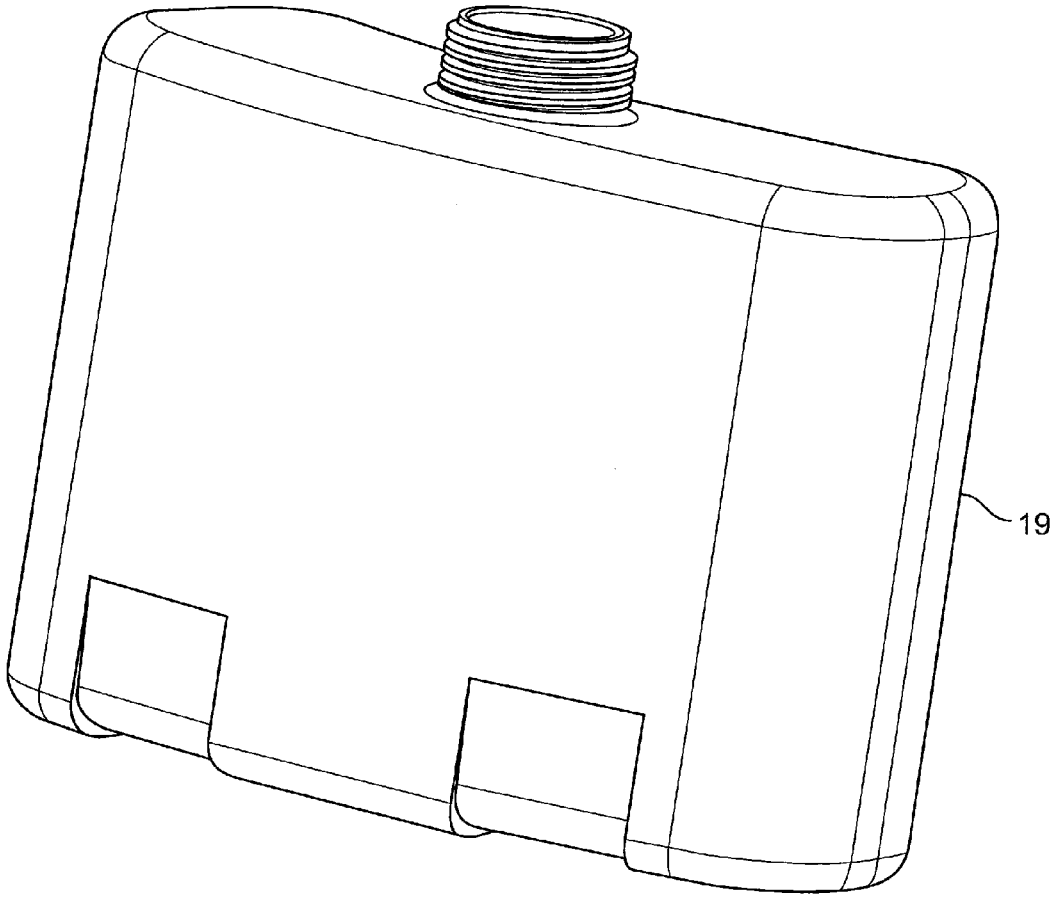
FIG. 8 is a perspective view of a typical container for the fluid to be sprayed, which container is designed to be carried on the belt of a sprayer operator.

Referring first to FIG. 1 there is illustrated the novel nozzle spray assembly 10 that is retained in position at the end of a blower pipe 40 (see FIG. 5) by the nozzle supports 12. These supports are adjustable so the nozzle assembly can be installed in various diameter pipes. The nozzle spray assembly consists of an interconnected upper half 14 and lower half 16. Formed with the lower half is an inlet tube 18 that is connected through a plastic valve controlled tube (not shown) to a source of insecticide in the container 19 (see FIG. 8). The container 19 can be connected to a belt of the person doing the spraying or as part of a backpack (not shown). The tanks can vary in size depending on the area to be sprayed. Examples of tanks are 1.5 gallons and 3 gallons that will provide enough insecticide to treat approximately 15,000 square feet and 30,000 square feet respectively. It can thus be appreciated that we have provided a portable readily useable spraying system that is very easy to use and provides an insect free area for an extended period of time.

Figure 2:
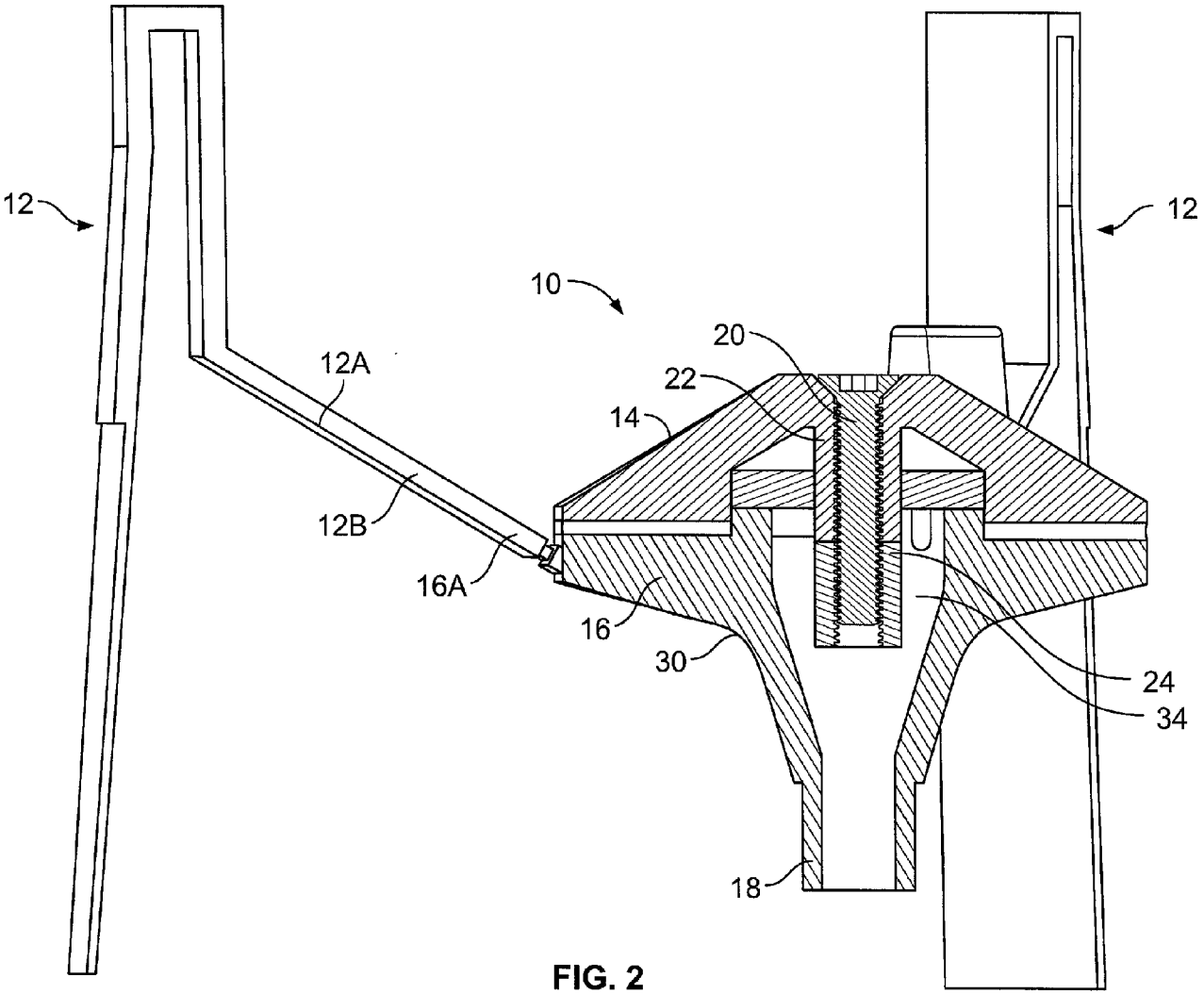
FIG. 2 is a view similar to FIG. 1 in which the assembly of FIG. 1 is partially broken away to illustrate the connection between the upper and lower halves of the nozzle assembly.

In FIG. 2, the assembly 10 of FIG. 1 is shown in partial cross-section wherein it is disclosed that the upper half 14 and lower half 16 are connected together by a self-tapping screw 20 extending through co-extensive tubular portions 22, 24 formed in the upper and lower halves 14, 16 respectively. FIG. 2 also disclosed the adjustability of the support arms 12 whereby the nozzle assembly can be mounted in various sizes of blower pipes 40. The supports 12 are inverted V-shapes that include an inwardly extending arm 12A that includes a slot 12B that receives an upwardly extending arm 16A that is formed with the lower half 16. The adjustability is brought about by movement of the arm 12A relative to the arm 16A.

Figure 3:
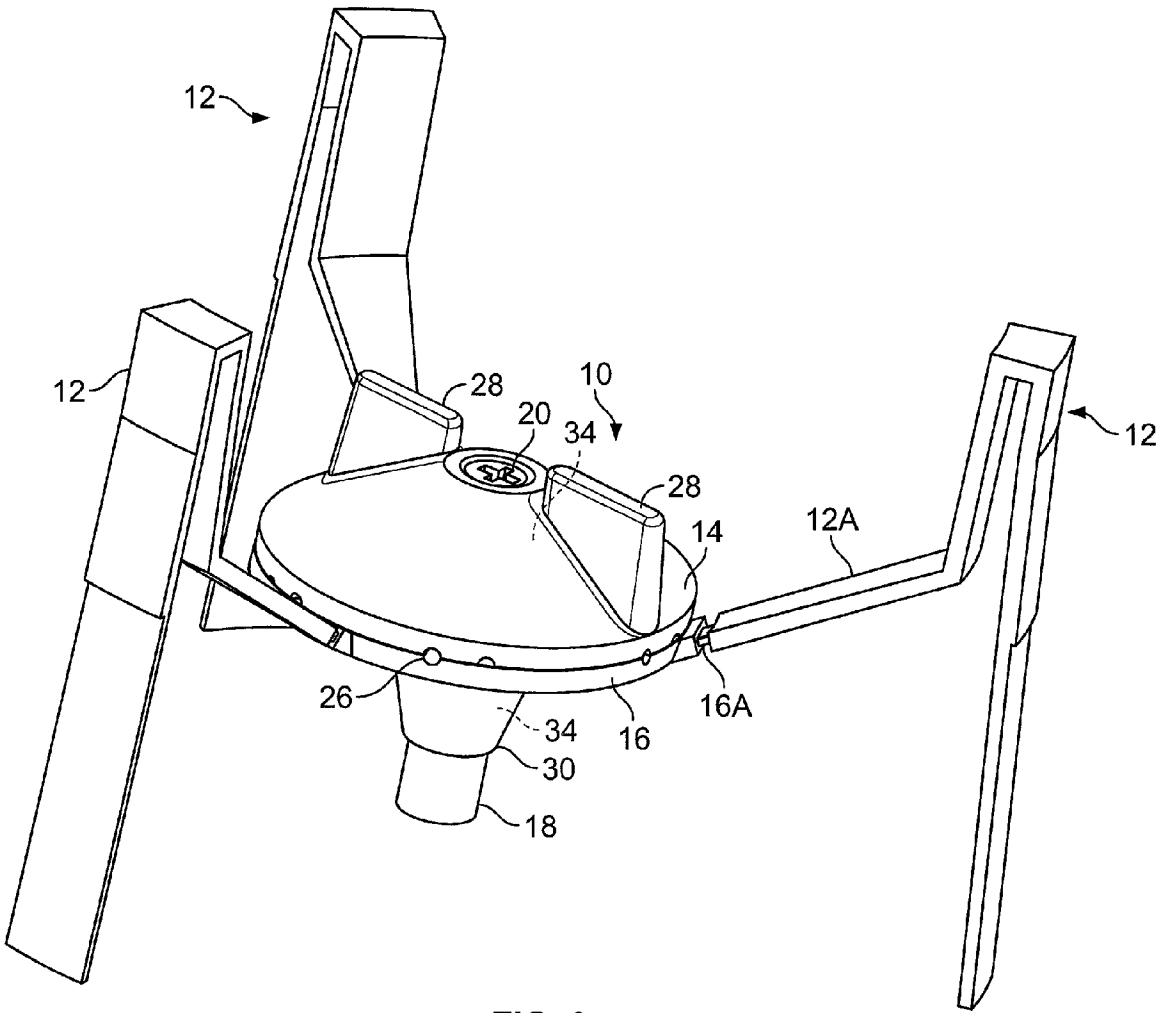
FIG. 3 is an enlarged perspective view of the nozzle assembly of FIG. 1 showing some of the internal areas of the nozzle assembly.

Turning now to FIG. 3 there is illustrated a perspective view of the nozzle spray assembly 10 and pipe supports 12 with various inner portions of the nozzle assembly being exposed. The upper half 14 is shown in a position whereby the maximum or high insecticide flow occurs through the nozzle outlets which in the position shown in FIG. 3 the nozzle outlet 26 is in the shape of a full circle. The control of the nozzle outlet flow is regulated by the movement of the upper nozzle half 14 relative to the lower half 16 by the winged tops 28. This arrangement will be discussed in greater detail with respect to FIGS. 6 and 7.

The theory upon which the novel nozzle spray assembly works is that the high pressure air from the air blower flowing through the blower pipe 40 is directed around the bottom arcuate surface 30 of the nozzle assembly which creates a vacuum at the nozzle openings. The vacuum sucks the insecticide from its storage container 19 through the inlet tube 18 into the nozzle reservoir area 34 and then out through the adjustable nozzle orifices disposed around the perimeter of the nozzle. In the illustrated embodiment, there are 6 groups of nozzle equally spaced about the perimeter of the nozzle assembly (see FIGS. 6 and 7). There can be more or less groups as desired. Each group consists of high, medium and low nozzle openings. The fluid sucked out of the nozzle openings is then sheared across the upper surfaces of the nozzle openings and turned into micro-droplets and dispersed into the air from the blower, creating a mist flow that can be directed to the area of treatment.

Figure 6:
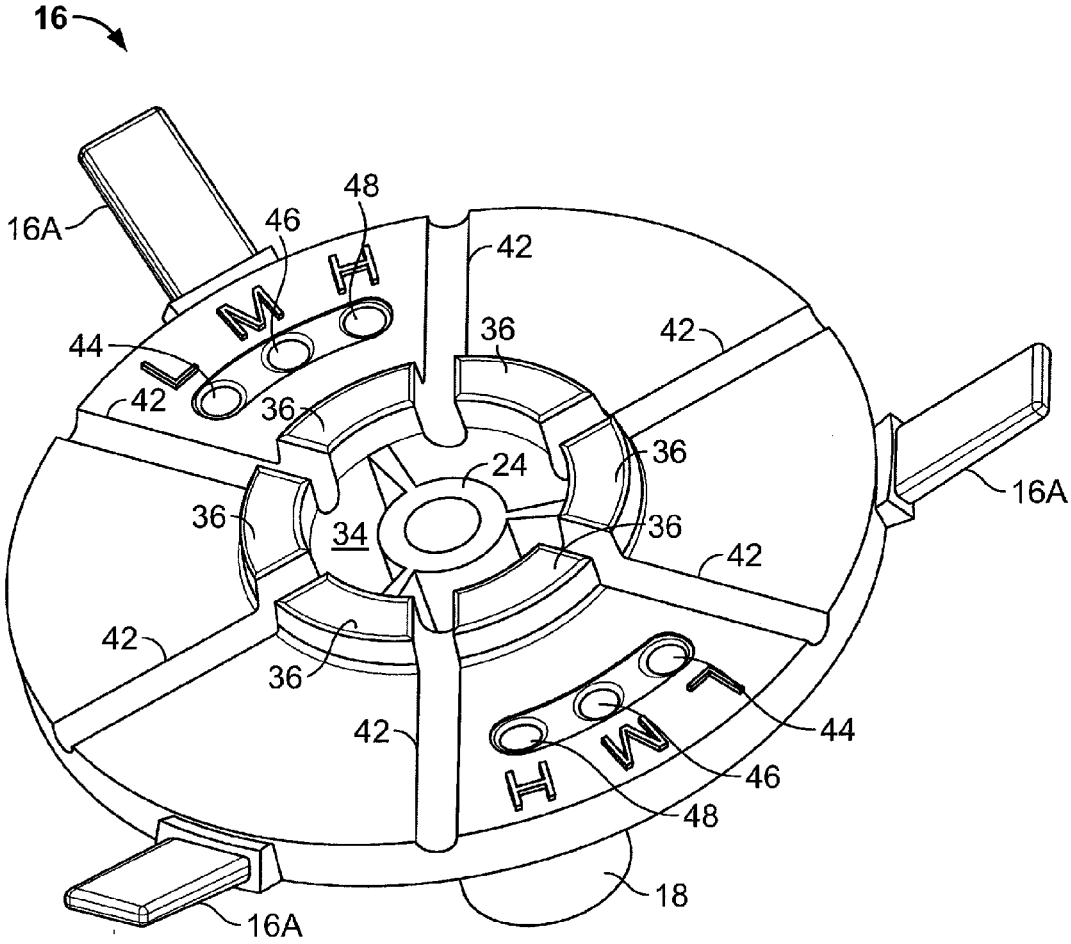
FIG. 6 is a perspective view of the bottom portion of the nozzle assembly shown connected to its supports used to mount the nozzle assembly in the air blower pipe.
Figure 7:
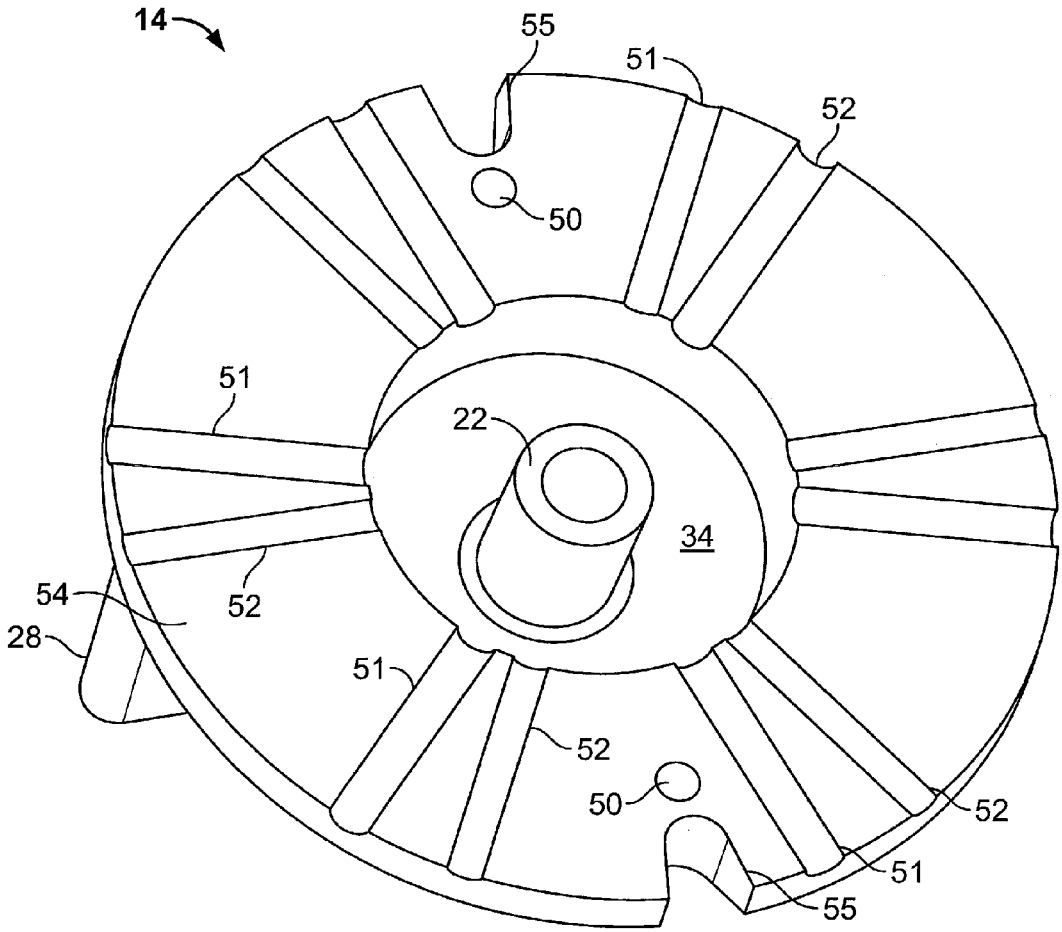
FIG. 7 is a perspective view of the top portion of the nozzle assembly shown in an inverted position.

To better understand the nozzle setting arrangement and the overall construction of applicants nozzle spray assembly reference is made to FIGS. 6 and 7 showing in perspective the separate upper and lower halves 14, 16 respectively of the nozzle assembly 10. Referring first to the lower half 16 there is shown 6 equally spaced semi-cylindrical flow channels 42 that lead from the central reservoir area 34 that receives insecticides from the attached container 19. More specifically, the inlet tube 18 leads to the reservoir areas 34 that are in communication with the channels 42 that are separated by the upwardly extending projections 36. The tube portion 24 at the center receives the self-tapping screw 20 when the upper and lower halves are connected together as shown in FIG. 2. Spaced between 2 of the channels 42 on opposite sides of the lower half 16 are indentations 44, 46, 48 that are marked to indicate the low, medium and high nozzle settings respectively when they are engaged by male bumps 50 in the upper half 14 (see FIG. 7).

Setting of the 6 identical sets of nozzle openings into the high, medium and low positions is accomplished by moving the upper half 14 relative to the lower half 16 by the manipulation of the wings 28 on top of the upper half 14. The movement of the upper half relative to the lower half is restrained by means (not shown) to limit adjustment only between the high and low positions.

As seen in FIG. 7 there are 6 sets of nozzle settings that may be positioned to connect with the semi-cylindrical flow channels 42 formed in the lower half 16. These sets of nozzle settings consist of "high setting" semi-cylindrical channels 51, "medium setting" modified channels 52 and "low" settings or flat surfaces 54 adjacent the flow channels 42.

Specifically, when the nozzle setting is placed in the "high" position by the male bumps 50 engaging the "high" indentation the channels 42, 51 are located opposite each other to form the largest opening. When the upper half is moved to the medium position the channels 42 and 52 are located opposite each other to form a smaller opening and when the upper half is turned to the low position 42 and the flat surface 54 is opposite the channel the nozzle opening is equal to the size of the channel 42 only.

Thus it can be seen that with each setting of the upper half (high, medium or low) there are 6 identical size nozzles open to spray insecticide therefrom.

Figure 4:
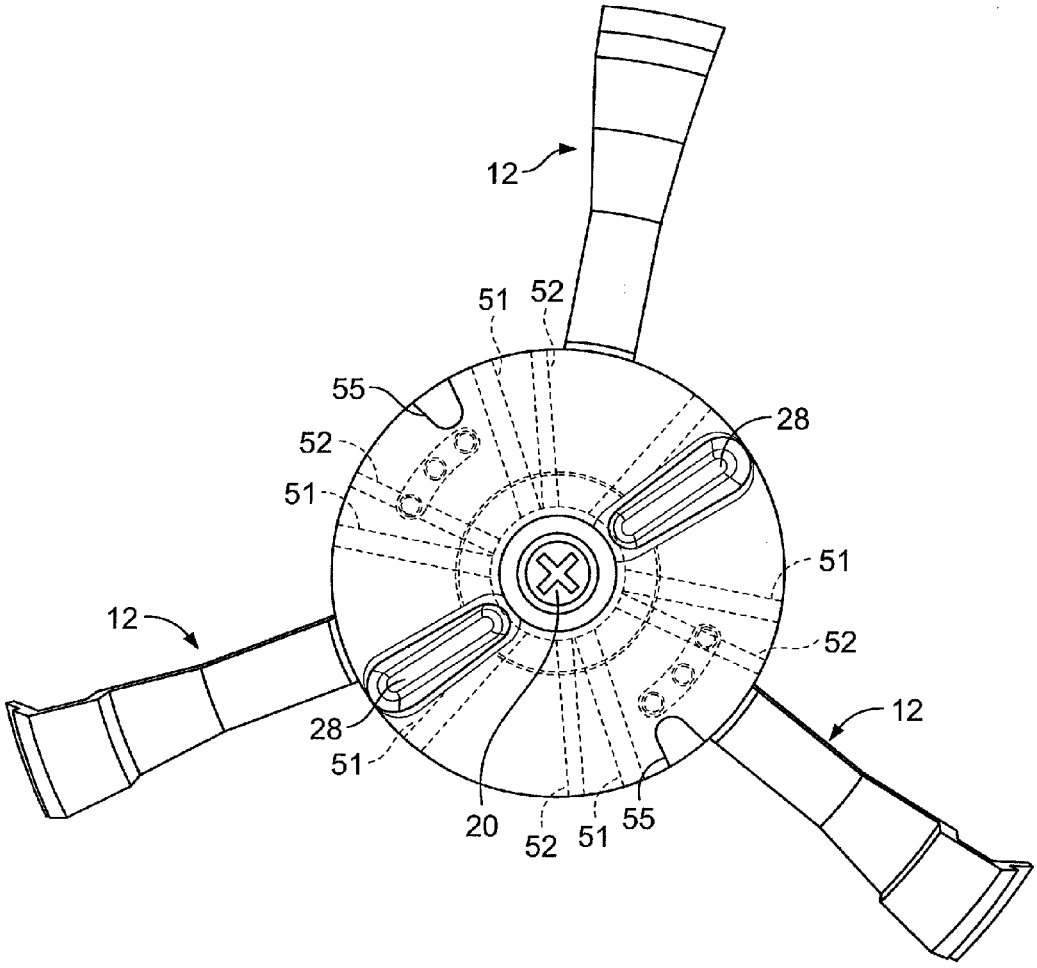
FIG. 4 is a plan view of the nozzle assembly and supports therefor prior to being mounted in the outlet pipe of an air blower.

To readily observe the location at which the nozzles have been set the top half is provided with flow indication cutouts 55 spaced at a 180° angle relative to each other (see FIG. 4).

Figure 5:
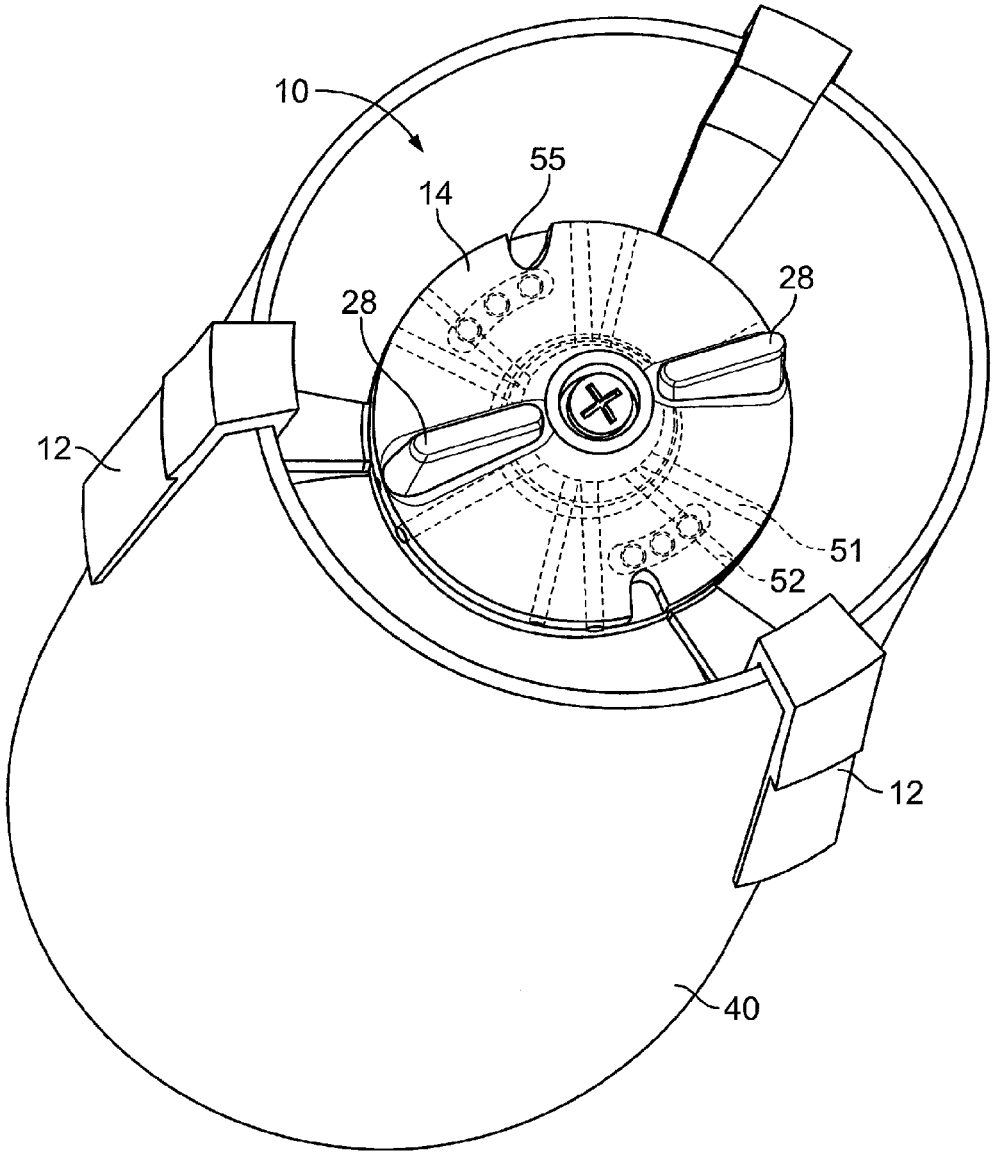
FIG. 5 is a top perspective view of the nozzle assembly of FIG. 4 shown mounted in the outlet pipe of an air blower.

FIG. 5 shows the nozzle assembly located in the blower pipe and being located in position by the supports 12. Velcro® can be used to hold the legs 12 in position relative to the blower pipe 40 to secure the nozzle assembly 10 in a central position relative to the pipe.

Figure 9:
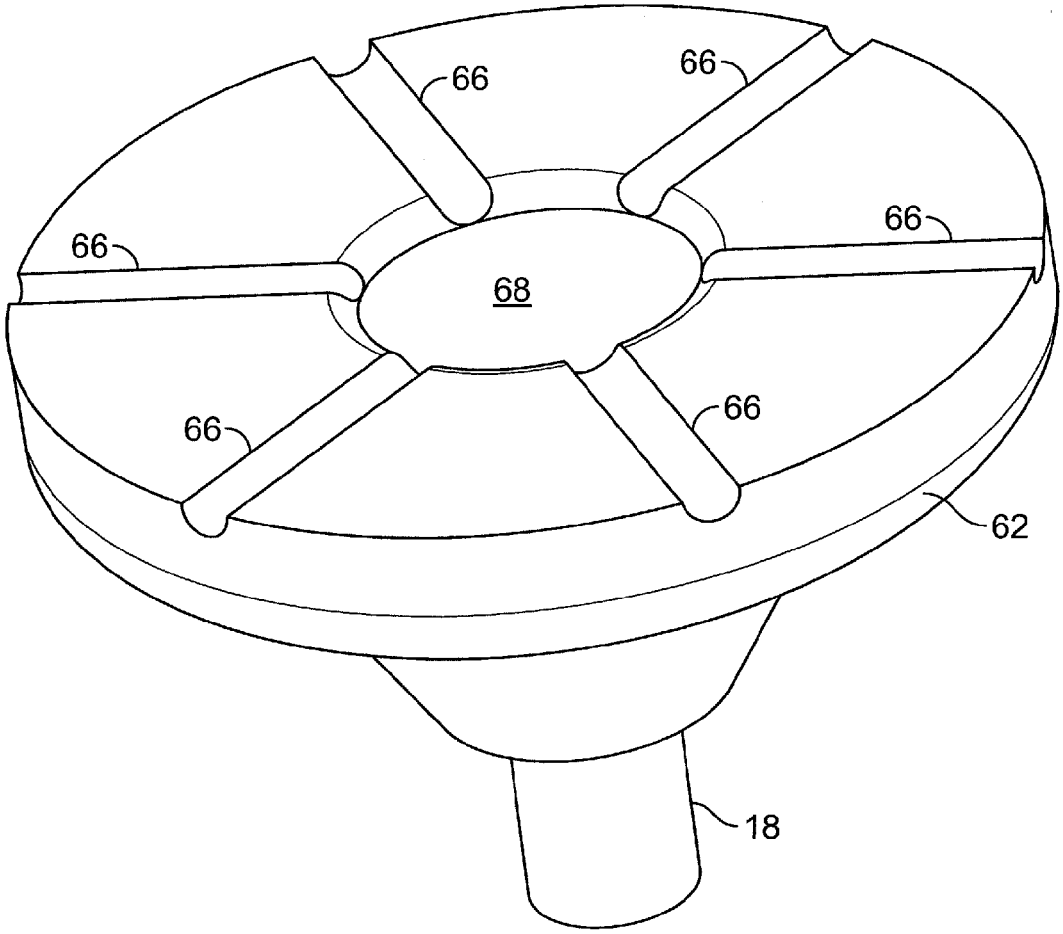
FIG. 9 is a perspective view of the bottom portion of a second embodiment of applicants novel nozzle assembly.

Reference is now made to FIGS. 9-12 which illustrate a second embodiment 60 of applicants novel spray assembly. FIG. 9 is a perspective view of the lower half 62 of the second embodiment and includes 6 equally spaced semi-cylindrical channels 66 which abut the flat lower surface 65 of the upper half 63 which is shown in perspective in FIGS. 10 and 11 and in cross-section in FIG. 12.

It is to be noted that embodiment 60 is not adjustable in that the nozzle settings are fixed and are equal to the cross-section of the semi-cylindrical channels 66 at the periphery of spray assembly.

Referring again to FIG. 9 it is seen that it includes a large central reservoir 68 that receives insecticide from the inlet tube 18 connected by a tube (not shown) to a container of insecticide 19. This construction results from the elimination of the self-tapping screw 20 which extended through the reservoir 34 in the adjustable version of the nozzle assembly of FIGS. 1-7.

Figure 10:
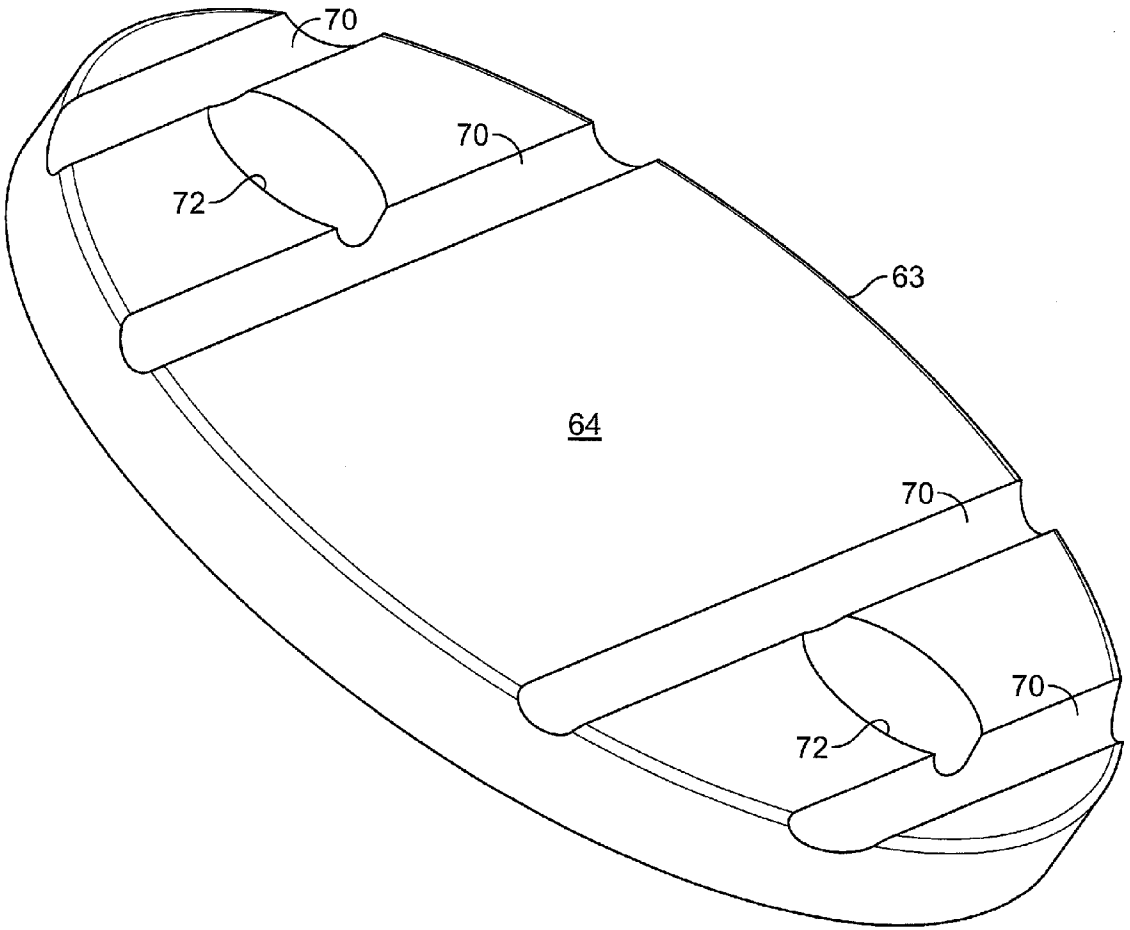
FIG. 10 is a perspective view of the top portion of applicants second embodiment.

The perspective view of the upper half 63 shown in FIG. 10 is circular and its lower surface 65 conforms to the upper surface of the lower half 62 but the angle at which it was taken distorts this representation.

Figure 11:
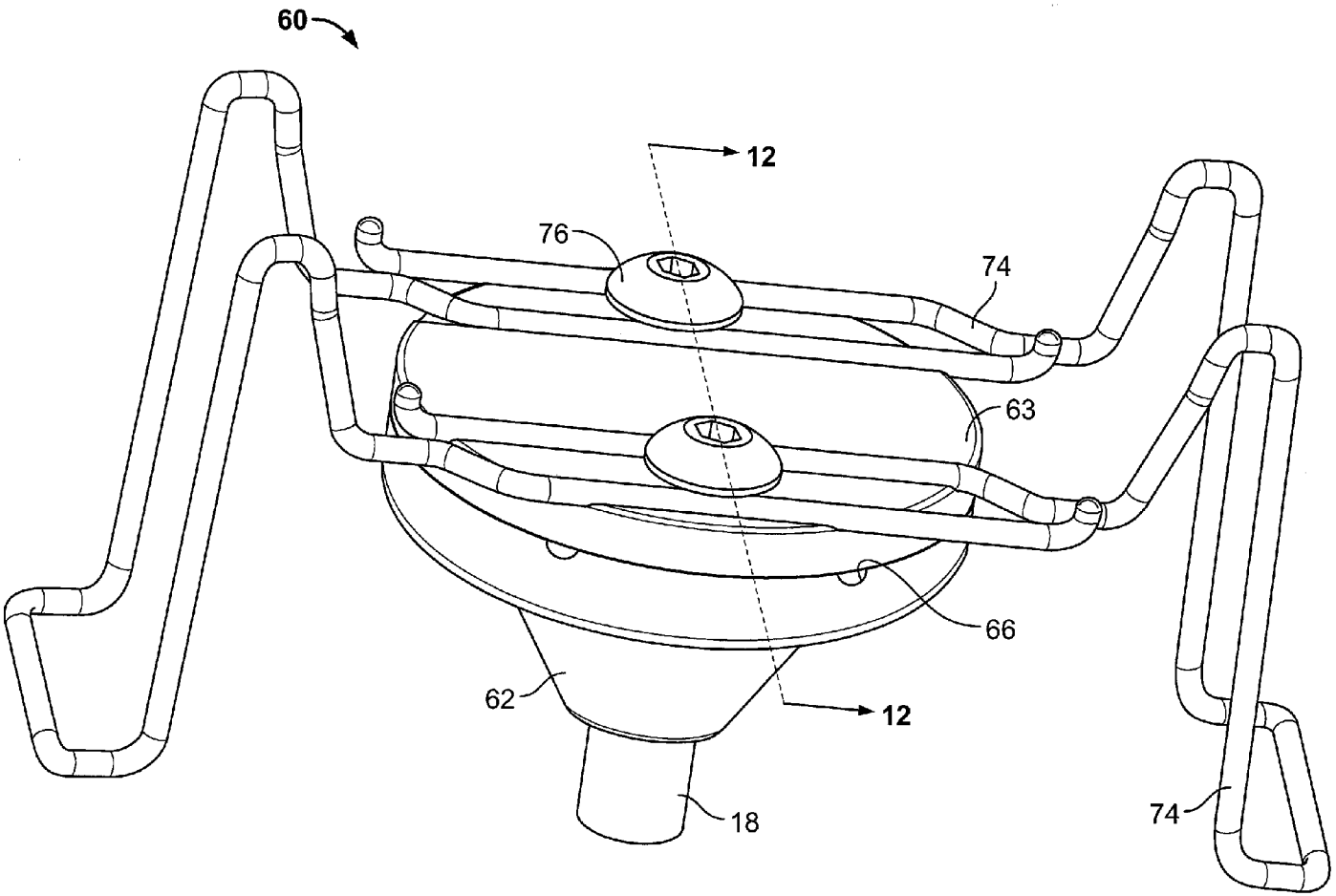
FIG. 11 is a perspective view similar to FIG. 10 illustrating wire connecting means for affixing the nozzle assembly to the outlet end of a blower pipe.
Figure 12:
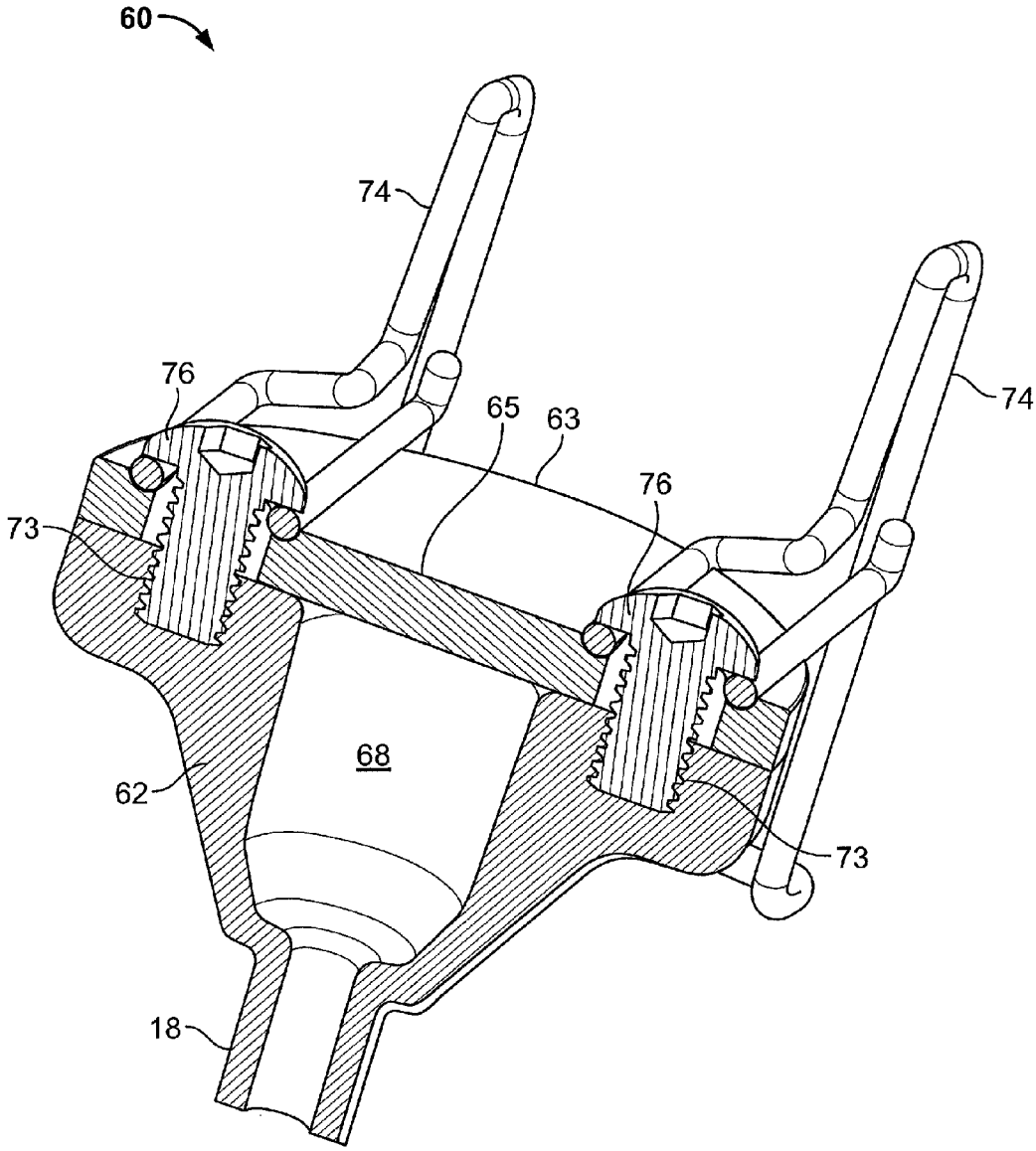
FIG. 12 is a perspective cross-sectional view taken along line 12-12 of FIG. 11.

In the upper surface 64 of the upper half 63 there are provided slots 70 for receive wire connectors 74 that will be described in conjunction with FIG. 11 and screw openings 72 for receiving self-tapping screws 72 for securing the upper half 63 and lower half 62 together as shown in FIG. 12.

Referring now to FIGS. 11 and 12 there is shown the relatively rigid wire or plastic if desired connectors 74 in position in the slots 70. The screws 76 extend through the openings 72 into self-tapped openings 73 in the lower half 62 of the spray assembly 60. The screws are not screwed tightly into position and thus the wire connectors can be adjusted to fit over the ends of whatever air blower pipe the nozzle assembly is to be secured to. When the connectors are located in position the screw 76 are tightened to securely connect the upper and lower halves together and restrain the connectors in position relative to the end of the air blower pipe as shown in FIG. 12.

Figure 13:
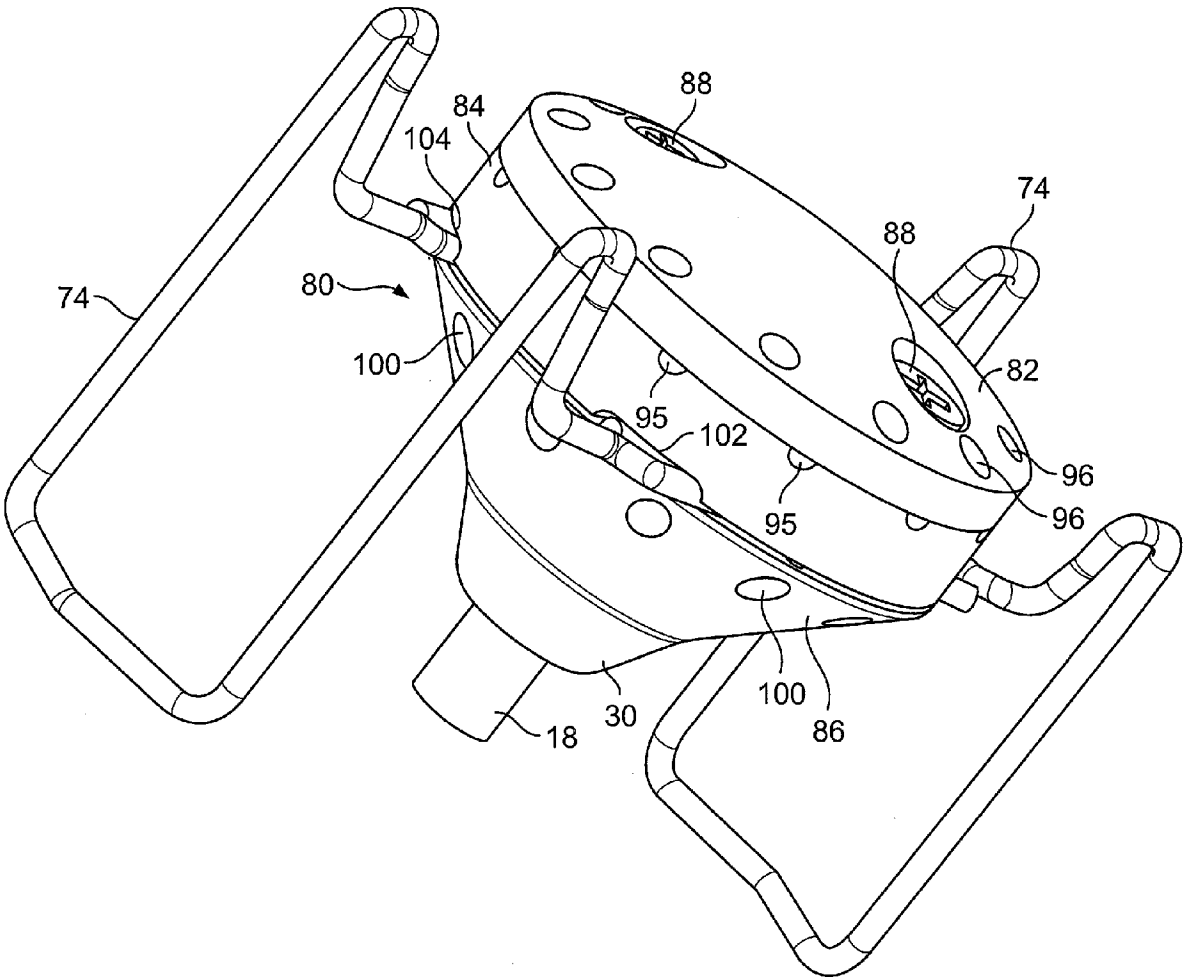
FIG. 13 is a perspective view of a third embodiment made up of upper, lower and intermediate sections.
Figure 14:
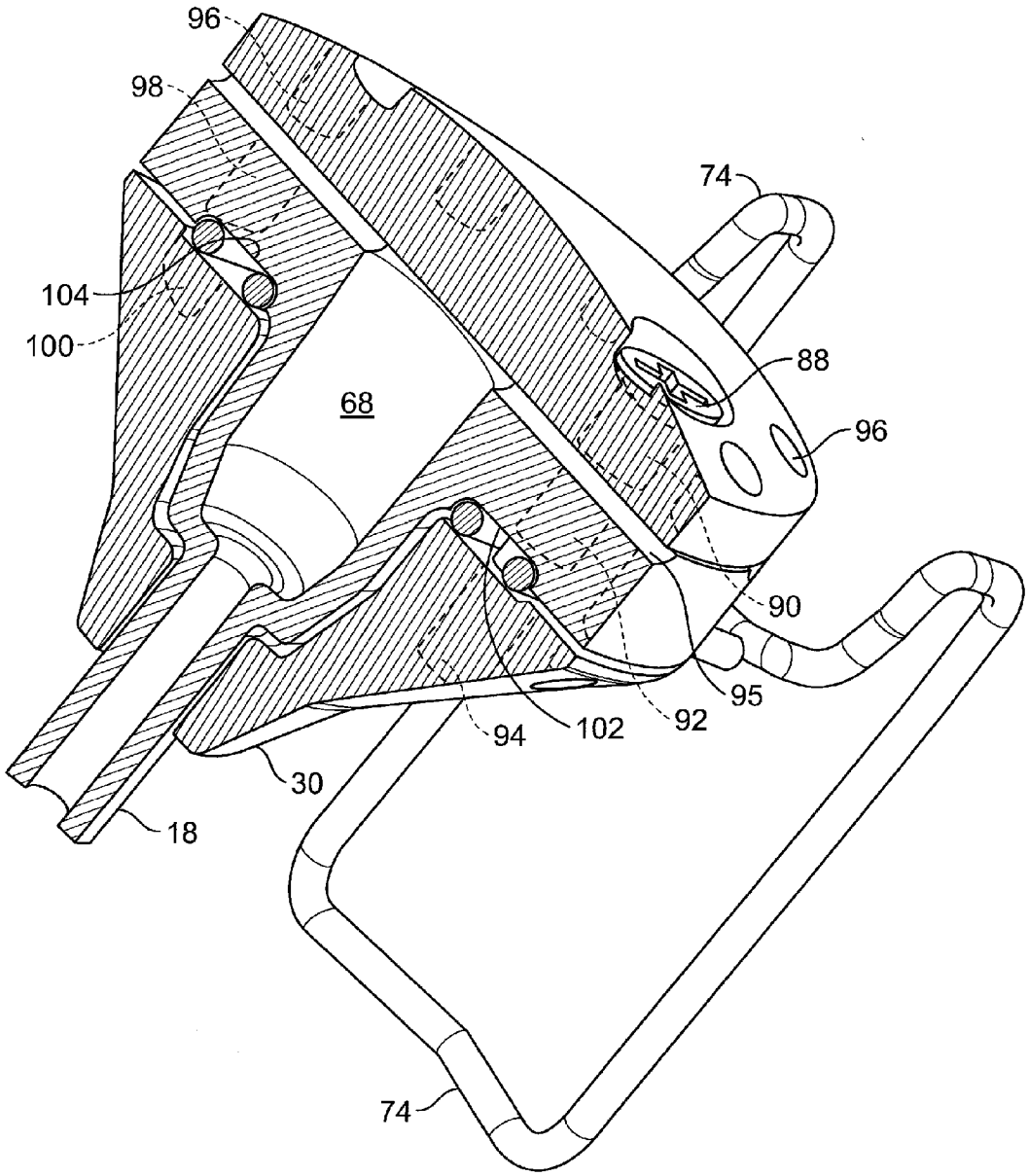
FIG. 14 is cross-sectional view of the embodiment shown in FIG. 13.
Figure 15:
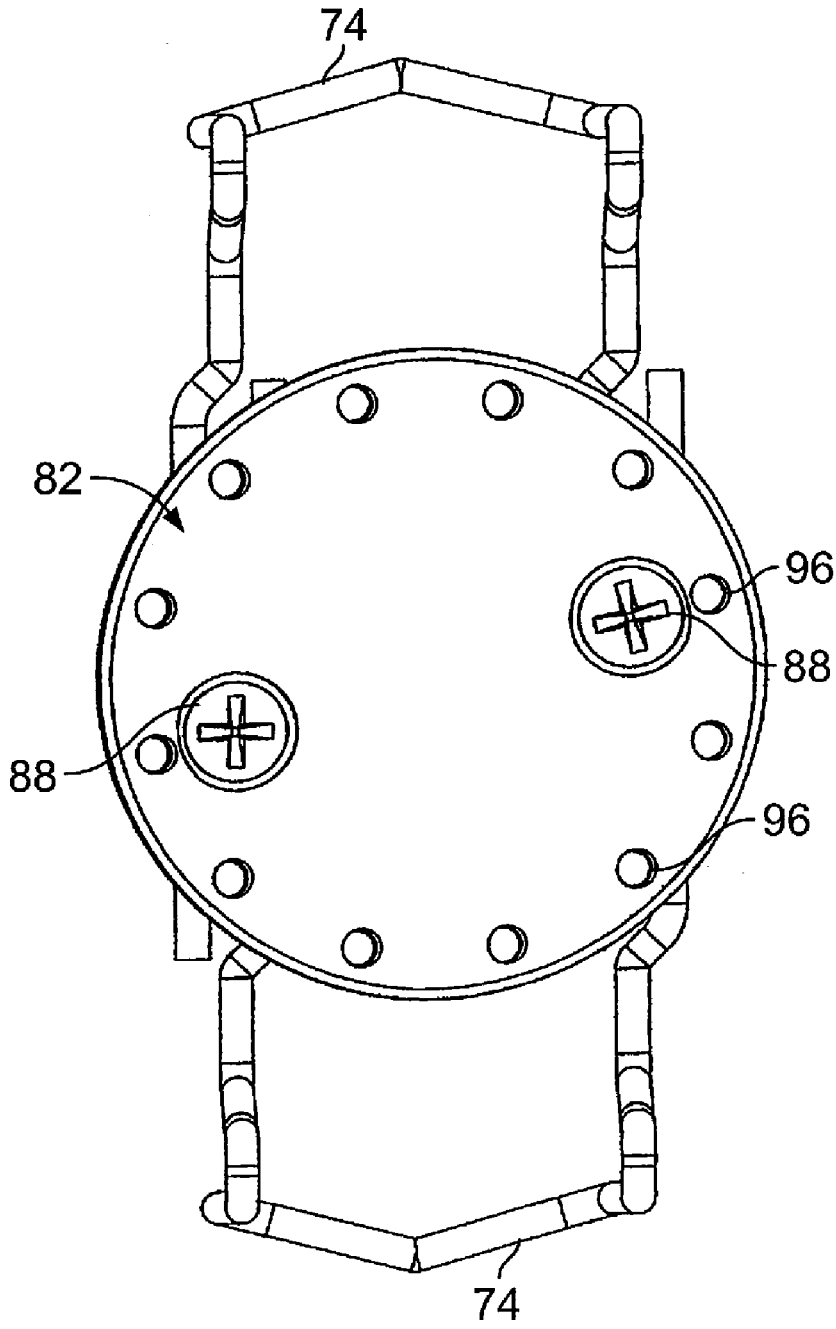
FIG. 15 is a top view of the embodiment shown in FIG. 13.
Figure 16:
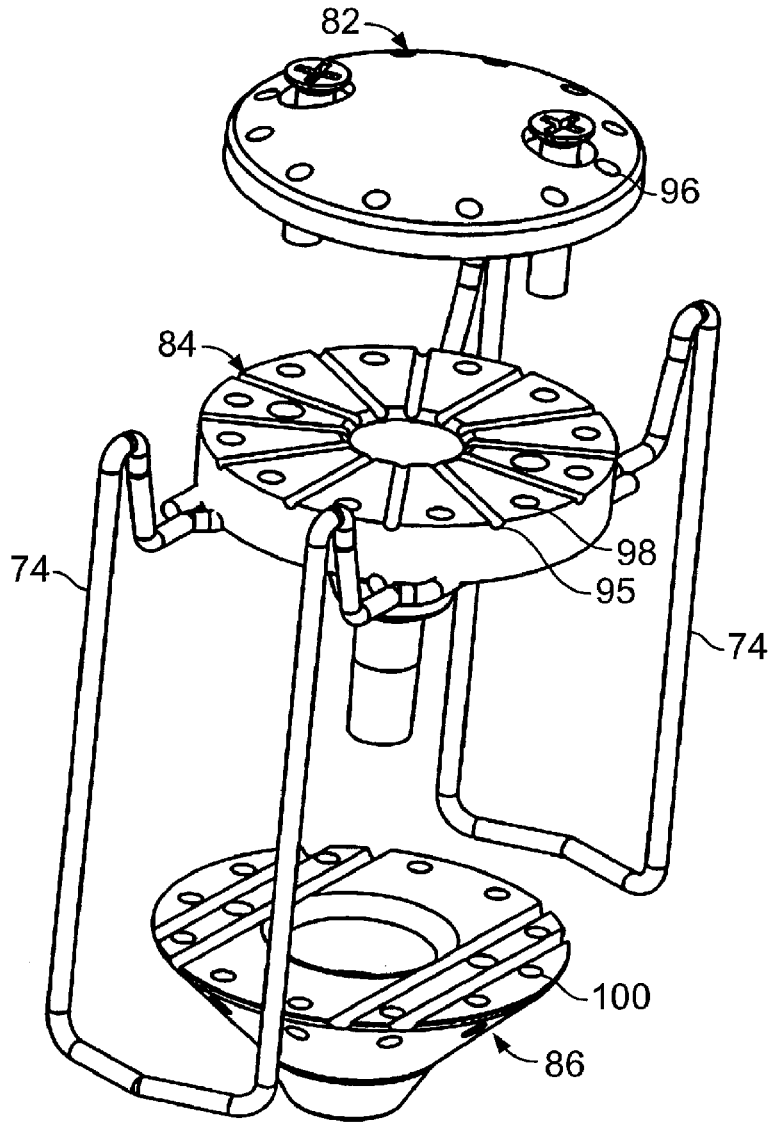
FIG. 16 is an exploded perspective view of the third embodiment.

Reference is now made to FIGS. 13-17 which illustrate a third embodiment 80 of applicants nozzle spray assembly. There are many components that are identical to those included in the second embodiment 60 and the identical numbers are used where appropriate. FIG. 13 is a perspective view of the assembly in condition to be inserted into the outlet of the blown pipe 40. The three sections 82, 84, 86 of the nozzle assembly are shown in the exploded position in FIG. 16. The internal construction of the nozzle assembly shown in FIG. 14 is generally similar to that illustrated and described with respect to FIG. 12 except that the tube portion 18 and reservoir 68 are formed as part of the intermediate section 84 (see FIG. 14). The sections are secured together by self-tapping screws 88 extending through aligned openings 90, 92, 94 in sections 82, 84, 86. The nozzle openings 95 formed in the upper surface of the intermediate section 84 are generally semi-cylindrical (see, FIG. 16).

The three sections 82, 84, 86 contain aligned peripherally disposed cylindrical openings 96, 98, 100 respectively through which air flows to facilitate the dispersion of the micro-droplets during spraying.

Figure 17:
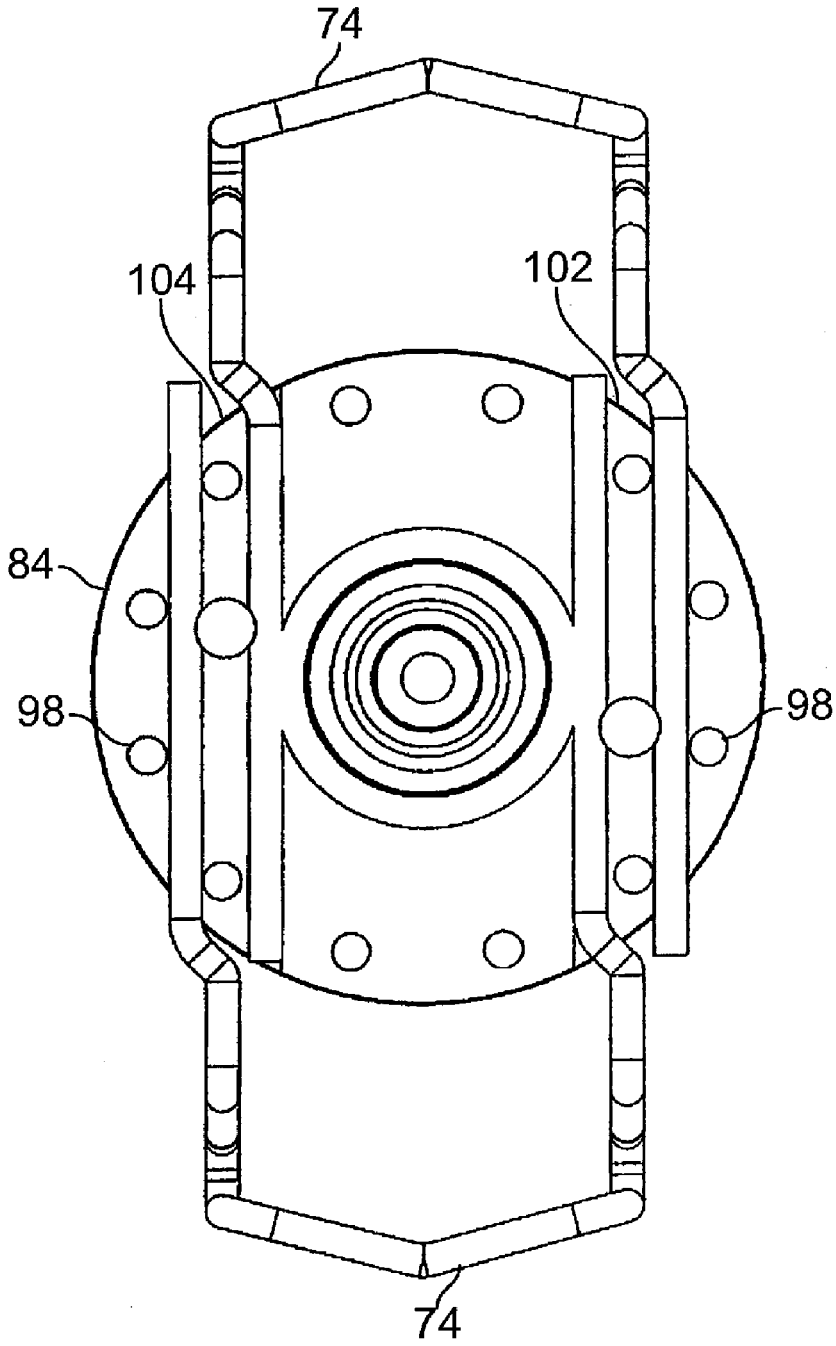
FIG. 17 is a bottom view of the intermediate section of the third embodiment.

The wire connectors 74 in the embodiment 80 are located in recesses 102, 104 formed in the bottom surface of intermediate section 84 as shown in FIGS. 13 and 17. They operate in the same manner as that disclosed with respect to the second embodiment 60 in that the sections 82, 84, 86 are loosely connected together and the connectors 74 are adjusted to locate the nozzle assembly in the outlet of the blower pipe. After the connectors are in position the screws 88 are tightened to firmly secure the sections 82, 84, 86 and connectors 74 together. The connectors 74 are firmly secured in the recesses 102, 104 between the intermediate section and the upper surface of the lower section.

By locating the connectors below the nozzle openings they are out of the way of the insecticide being withdrawn from the central reservoir area 34 thus permitting the insecticide to flow freely into the atmosphere.

Method of Operation

In the applicants first embodiment the nozzle spray system is located in place relative to the end of the blower pipe by disposing the three legs 12 over the end of pipe 40. To hold the legs in position a velcro strap or some other suitable fastening means securely wraps the three legs to the pipe 40. A plastic tube (not shown) leading from the tank to the inlet tube 18 is affixed in position by wire ties. The flow through the plastic tube is controlled by a pinch valve (not illustrated) on the clear or any color plastic tubing. With the valve on the tubing in the closed position a pre-measured amount of insecticide liquid is placed in a tank and is filled with the requisite amount of water, the tank is placed in a belt holder and the spraying can then begin.

After being moved to the location to be misted the sprayer is set to the desirable nozzle setting by adjusting the upper half of the nozzle assembly to the high, medium or low positions. The air blower is then turned on to direct high pressure air through the blower pipe 40. The high pressure air is directed by the arcuate surfaces 30 past the nozzle openings. The high pressure air past the nozzle openings creates a vacuum at the nozzle openings to draw the mixture of water and insecticide from the tank through the tube and into the nozzle spray assembly reservoir 34. From the reservoir 34 the mixture flows out of the 6 nozzle openings. The fluid is then sheared across the top of the nozzle openings and turned into micro-droplets and dispersed into the air from the blower creating a mist flow that can be directed to the area of treatment.

In applicants second embodiment the wire connectors 74 are disposed over the end of the blower pipe adjusted into position and the screws 76 are then tightened to secure the halves of the nozzle assembly and lock the connectors in position.

In the third embodiment the wire connectors between the intermediate and bottom sections 84, 86 are positioned over the end of the blower pipe and the screws 88 are then tightened to secure the three sections and connectors together.

When the liquid runs out the valve is closed and the blower turned off.

It is intended to cover by the attached claims all such features and embodiments that come within the true spirit and scope of the invention.

The invention claimed is:

1. A nozzle spray assembly for insecticide comprising:

an upper half;

a lower half defining an arcuate surface and including an inlet tube for receiving fluid to be dispensed, the inlet tube in communication with a reservoir defined by the upper and lower halves;

first connecting means for movably connecting the upper and lower halves; and second connecting means for connecting the nozzle spray assembly to an outlet conduit of an air blower assembly, in which the second connecting means comprises a plurality of leg means to be disposed over the end of the outlet conduit and means for securing the legs to the outlet conduit;

wherein the upper and lower halves further conjointly define conjoint nozzle openings adjacent the arcuate surface such that, when air is directed over the arcuate surface past the nozzle openings, fluid is sucked into the inlet tube and reservoir and out said nozzle openings for spraying insecticide onto a surrounding area.

2. A nozzle spray assembly as set forth in claim 1 in which the inlet tube is connected to a container filled with liquid to be sprayed.

3. A nozzle spray assembly as set forth in claim 2 in which the container for the insecticide is supported on a backpack or belt of an operator.

4. A nozzle spray assembly as set forth in claim 1 in which the upper half includes upwardly extending wings for rotating the upper half relative to the lower half.

5. A nozzle spray assembly for insecticide comprising:

an upper half having an upper surface and a lower surface;

a lower half having an upper surface and an arcuate surface, and including an inlet tube for receiving fluid to be dispensed, the inlet tube in communication with a reservoir defined by the upper and lower halves;

nozzle openings adjacent the arcuate surface conjointly defined by channels in the upper surface of the lower half and varying sized channels in the lower surface of the upper half, whereby, when air is directed over the arcuate surface past the nozzle openings, fluid is sucked into the inlet tube and reservoir and out the nozzle openings for spraying the fluid onto a surrounding area; and means movably connecting the upper and lower halves such that rotation of the upper half relative to the lower half varies the size of the nozzle openings to regulate the quantities of fluid being sprayed.

6. A nozzle spray assembly as set forth in claim 5 in which the channels in the lower half are equally spaced and generally semi-cylindrical and the channels in the upper half vary between the size of the channels in the lower half and a flat surface whereby the total size of the nozzle opening will be between double the size of the channels in the lower half and the size of the channels in the lower half.

7. A nozzle spray assembly as set forth in claim 6 provided with cooperating bumps and recesses in the upper and lower halves to positively locate the halves in position relative to each other.

8. A nozzle spray assembly as set forth in claim 7 in which the upper and lower halves are provided with cooperating indicia and flow indicator cut-outs.

* * * * *